US010273983B2

(12) United States Patent
Yoshida et al.

(10) Patent No.: US 10,273,983 B2
(45) Date of Patent: Apr. 30, 2019

(54) WORKING MACHINE CONTROL SYSTEM AND LOWER PRESSURE SELECTION CIRCUIT

(71) Applicant: KYB Corporation, Tokyo (JP)

(72) Inventors: Nobuyoshi Yoshida, Tokyo (JP); Ikuo Inagaki, Saitama (JP)

(73) Assignee: KYB Corporation, Tokyo (JP)

( * ) Notice: Subject to any disclaimer, the term of this patent is extended or adjusted under 35 U.S.C. 154(b) by 216 days.

(21) Appl. No.: 15/032,908

(22) PCT Filed: Jan. 27, 2015

(86) PCT No.: PCT/JP2015/052206
§ 371 (c)(1),
(2) Date: Apr. 28, 2016

(87) PCT Pub. No.: WO2015/115428
PCT Pub. Date: Aug. 6, 2015

(65) Prior Publication Data

US 2016/0265560 A1 Sep. 15, 2016

(30) Foreign Application Priority Data

Jan. 31, 2014 (JP) ..... 2014-016473

(51) Int. Cl.
*F15B 11/10* (2006.01)
*E02F 9/22* (2006.01)
(Continued)

(52) U.S. Cl.
CPC ..... *F15B 11/10* (2013.01); *E02F 9/2228* (2013.01); *E02F 9/2232* (2013.01);
(Continued)

(58) Field of Classification Search
CPC ..... E02F 9/2267; E02F 9/2235; E02F 9/2232; E02F 9/2296; E02F 9/2228; E02F 9/2292;
(Continued)

(56) References Cited

U.S. PATENT DOCUMENTS 6,330,797 B1 12/2001 Kondo
2006/0266210 A1* 11/2006 Zhang ..... E02F 9/2225 91/446

FOREIGN PATENT DOCUMENTS

CN 101946096 A 1/2011
JP H10-88627 A 4/1998
(Continued)

OTHER PUBLICATIONS

Wang Guanghuai, "Application of hydraulic pressure technology," 1st edition, 1st print, Harbin Institute of Technology Press, May 31, 2001 (May 31, 2001), ISBN Jul. 5603-1562-3; (Claims 1, 3), pp. 81-83—Concise explanation of relevance is provided.

*Primary Examiner* — Abiy Teka
(74) *Attorney, Agent, or Firm* — Rabin & Berdo, P.C.

(57) ABSTRACT

A working machine control system includes a split flow type fluid pressure pump configured to discharge a working fluid from a first discharge port and a second discharge port, and a lower pressure selection circuit configured to select and communicate with a working fluid of lower pressure among a working fluid on the downstream of a first operation valve of a first neutral passage in a first circuit system to which a working fluid discharged from the first discharge port is supplied, and a working fluid on the downstream of a second operation valve of a second neutral passage in a second circuit system to which a working fluid discharged from the second discharge port is supplied. The fluid pressure pump is adjusted in such a manner that the lower the pressure of
(Continued)

the working fluid selected by the lower pressure selection circuit is, the more a discharge flow rate is increased.

6 Claims, 4 Drawing Sheets

(51) Int. Cl.
*F15B 11/17* (2006.01)
*F15B 13/02* (2006.01)
*E02F 3/32* (2006.01)

(52) U.S. Cl.
CPC ..... *E02F 9/2235* (2013.01); *E02F 9/2267* (2013.01); *E02F 9/2282* (2013.01); *E02F 9/2285* (2013.01); *E02F 9/2292* (2013.01); *E02F 9/2296* (2013.01); *F15B 11/17* (2013.01); *F15B 13/026* (2013.01); *E02F 3/32* (2013.01); *F15B 2211/20546* (2013.01); *F15B 2211/20576* (2013.01); *F15B 2211/45* (2013.01); *F15B 2211/7142* (2013.01)

(58) Field of Classification Search
CPC ..... E02F 9/2282; E02F 9/2285; F15B 13/026; F15B 11/17; F15B 11/10; F15B 2211/6054
See application file for complete search history.

(56) References Cited

FOREIGN PATENT DOCUMENTS

| | | | |
|---|---|---|---|
| JP | 2000-074233 | A | 3/2000 |
| WO | WO-2009/123047 | A1 | 10/2009 |

* cited by examiner

WORKING MACHINE CONTROL SYSTEM AND LOWER PRESSURE SELECTION CIRCUIT

TECHNICAL FIELD

The present invention relates to a working machine control system and a lower pressure selection circuit.

BACKGROUND ART

Conventionally, a working machine such as a hydraulic excavator including a plurality of circuit systems, in which working oil is supplied from a plurality of hydraulic pumps to the respective circuit systems is known. JP10-088627A discloses an excavating rotating working machine in which working oil is supplied from a first pump, a second pump, and a third pump to respective circuit systems.

SUMMARY OF INVENTION

In a working machine such as a hydraulic excavator, there is sometimes a case where a split flow pump in which discharge ports are divided and arranged in two stages in a single cylinder block and working oil can be discharged to two systems at the same time is used instead of two hydraulic pumps. In a case where the split flow pump is used, discharge flow rates of the working oil to the two circuit systems are the same. Therefore, there is a need for detecting whether or not an operation valve is switched and an actuator is activated in each of the two circuit systems by a pressure sensor or the like, and adjusting the discharge flow rate of the split flow pump.

An object of the present invention is, in a case where a split flow pump is used in a working machine including a plurality of circuit systems, to be able to adjust a discharge flow rate of the split flow pump with a simple configuration.

According to an aspect of the present invention, a working machine control system configured to control a working machine having a first actuator and a second actuator, includes: a split flow type fluid pressure pump configured to discharge a working fluid from a first discharge port and a second discharge port; a first circuit system to which a working fluid discharged from the first discharge port is supplied, the first circuit system having a first operation valve configured to control the first actuator, and a first neutral passage providing communication between the first discharge port and a tank in a state where the first operation valve is placed at a normal position; a second circuit system to which a working fluid discharged from the second discharge port is supplied, the second circuit system having a second operation valve configured to control the second actuator, and a second neutral passage providing communication between the second discharge port and the tank in a state where the second operation valve is placed at a normal position; and a lower pressure selection circuit configured to select and communicate with a working fluid of lower pressure among a working fluid on the downstream of the first operation valve of the first neutral passage, and a working fluid on the downstream of the second operation valve of the second neutral passage. The fluid pressure pump is adjusted in such a manner that the lower the pressure of the working fluid selected by the lower pressure selection circuit is, the more a discharge flow rate is increased.

DESCRIPTION OF EMBODIMENTS

Hereinafter, a working machine control system (hereinafter, simply referred to as the "control system") 100 according to an embodiment of the present invention will be described with reference to the drawings.

Figure 1:
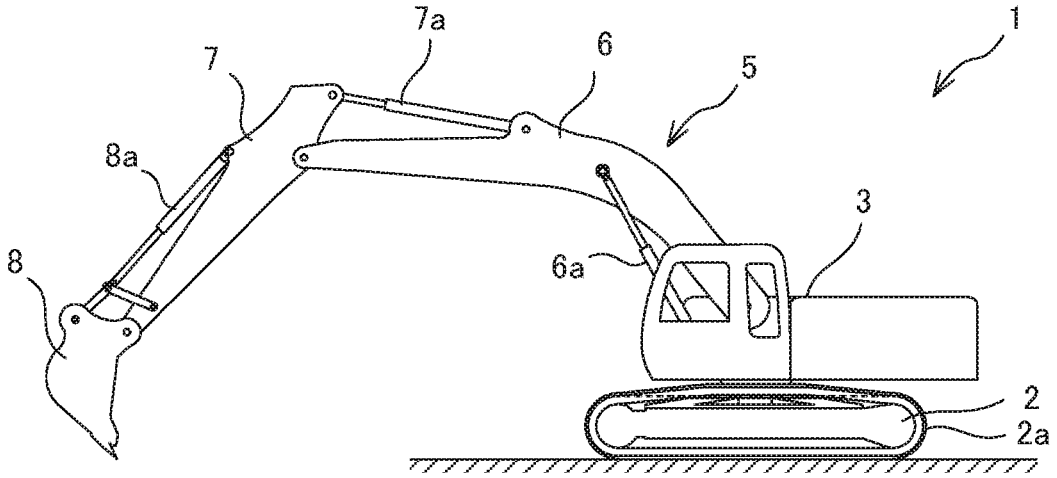
FIG. 1 is a configuration diagram of a working machine to which a working machine control system according to an embodiment of the present invention is applied.

Firstly, with reference to FIG. 1, a hydraulic excavator 1 served as a working machine to which the control system 100 is applied will be described. Although a case where the working machine is the hydraulic excavator 1 will be described herein, the control system 100 is applicable to other working machines such as a wheel loader. Although working oil is used as a working fluid herein, other fluids such as working water may be used as the working fluid.

The hydraulic excavator 1 includes a crawler type traveling section 2, a rotating section 3 rotatably provided in an upper part of the traveling section 2, and an excavating section 5 provided in a front center part of the rotating section 3.

The traveling section 2 lets the hydraulic excavator 1 travel by driving a pair of left and right crawlers 2*a* by traveling motors (not shown). The rotating section 3 is driven by a rotating motor (not shown), and rotated in the left and right direction with respect to the traveling section 2.

The excavating section 5 includes a boom 6 supported pivotably about a horizontal shaft extending in the left and right direction of the rotating section 3, an arm 7 pivotably supported in a leading end of the boom 6, and a bucket 8 pivotably supported in a leading end of the arm 7, the bucket being adapted to excavate earth and sand and the like. The excavating section 5 also includes a boom cylinder 6*a* adapted to pivot the boom 6 upward and downward, an arm cylinder 7*a* adapted to pivot the arm 7 upward and downward, and a bucket cylinder 8*a* adapted to pivot the bucket 8.

Next, with reference to FIGS. 2 and 3, a configuration of the control system 100 will be described.

The control system 100 includes a hydraulic pump 10 serving as a fluid pressure pump adapted to discharge the working oil, a first circuit system 20 to which working oil discharged from a first discharge port 12 is supplied, a second circuit system 30 to which working oil discharged from a second discharge port 13 is supplied, and a lower pressure selection circuit 40 adapted to select and communicate with working oil of lower pressure among working oil on the downstream of operation valves 21 to 23 of a first neutral passage 25 in the first circuit system 20, and working oil on the downstream of operation valves 31 to 34 of a second neutral passage 35 in the second circuit system 30.

The control system 100 is to control actions of a plurality of actuators of the hydraulic excavator 1. In addition to the hydraulic pump 10, the control system 100 includes another pump (not shown) adapted to supply the working oil to a third circuit system (not shown) having another actuator such as the rotating motor.

The hydraulic pump 10 is driven by an engine (not shown). The hydraulic pump 10 is a split flow type pump in which the first discharge port 12 and the second discharge port 13 are divided and arranged in two stages in a single cylinder block (not shown) and the working oil can be discharged to two systems at the same time. The hydraulic pump 10 proportionally divides the working oil from the first discharge port 12 and the second discharge port 13 and discharges.

The hydraulic pump 10 is a variable capacity type pump including a swash plate (not shown) whose inclination angle is adjusted by a regulator 11 to be controlled by pilot pressure, the pump in which a discharge flow rate is adjusted by the inclination angle of the swash plate. In the hydraulic pump 10, with pressure of the working oil selected by the lower pressure selection circuit 40 as the pilot pressure, the inclination angle of the swash plate is adjusted in such a manner that the lower the pilot pressure is, the more the discharge flow rate is increased. In the hydraulic pump 10, the discharge flow rates of the working oil discharged from the first discharge port 12 and the second discharge port 13 are adjusted by the single regulator 11.

The working oil discharged from the hydraulic pump 10 is respectively supplied to the first circuit system 20 and the second circuit system 30 through a first discharge passage 15 connected to the first discharge port 12 and a second discharge passage 16 connected to the second discharge port 13.

On the downstream of the first discharge passage 15 and the second discharge passage 16, a main relief valve 18 to be opened when the pressure exceeds predetermined main relief pressure to maintain the working oil pressure to the main relief pressure or lower is provided. Check valves 15*a*, 16*a* adapted to allow only flows of the working oil toward the main relief valve 18 are respectively provided in the first discharge passage 15 and the second discharge passage 16. The predetermined main relief pressure is set to be so high that the lowest working pressure of the operation valves 21 to 23, 31 to 34 to be described later can be sufficiently ensured.

The first circuit system 20 includes the operation valve 21 adapted to control the traveling motor of the left crawler 2*a*, the operation valve 22 adapted to control the boom cylinder 6*a*, and the operation valve 23 adapted to control the bucket cylinder 8*a* in order from the upstream side. These operation valves 21 to 23 correspond to a first operation valve, and the traveling motor, the boom cylinder 6*a*, and the bucket cylinder 8*a* correspond to a first actuator. The first circuit system 20 includes the first neutral passage 25 providing communication between the first discharge passage 15 and a tank 19 in a state where all the operation valves 21 to 23 are placed at normal positions, and a parallel passage 26 provided in parallel to the first neutral passage 25.

On the downstream side of the operation valve 23 in the first neutral passage 25, a throttle 27 for generating pilot pressure as negative control pressure is provided. In the throttle 27, a pilot relief valve 28 to be opened when the pilot pressure generated on the upstream side of the throttle 27 exceeds predetermined pilot relief pressure to maintain the pilot pressure to the pilot relief pressure or lower is provided in parallel. The predetermined pilot relief pressure is set to be lower than the main relief pressure of the main relief valve 18 so that abnormal pressure is not generated in the throttle 27.

On the upstream side of the throttle 27, a first pilot passage 29 is connected. The pilot pressure generated by the throttle 27 is guided to the first pilot passage 29. The first pilot passage 29 is connected to the lower pressure selection circuit 40.

The operation valves 21 to 23 control a flow rate of the working oil guided from the hydraulic pump 10 to the actuators to control the actions of the actuators. The operation valves 21 to 23 are operated by pilot pressure supplied in accordance with a manual operation of an operation lever by an operator of the hydraulic excavator 1.

The operation valve 21 is normally placed at the normal position by bias force of a pair of centering springs, and switched between a first switching position and a second switching position by pilot pressure supplied from pilot passages 21*a*, 21*b*. The operation valve 22 is normally placed at the normal position by bias force of a pair of return springs, and switched between a first switching position and a second switching position by pilot pressure supplied from pilot passages 22*a*, 22*b*. The operation valve 23 is normally placed at the normal position by bias force of a pair of return springs, and switched between a first switching position and a second switching position by pilot pressure supplied from pilot passages 23*a*, 23*b*.

The second circuit system 30 includes the operation valve 31 adapted to control the traveling motor of the right crawler 2*a*, the operation valve 32 adapted to control an auxiliary actuator, the operation valve 33 adapted to similarly control the auxiliary actuator, and the operation valve 34 adapted to control the arm cylinder 7*a* in order from the upstream side. These operation valves 31 to 34 correspond to a second operation valve, and the traveling motor, the auxiliary actuator, and the arm cylinder 7*a* correspond to a second actuator. The second circuit system 30 includes the second neutral passage 35 providing communication between the second discharge passage 16 and the tank 19 in a state where all the operation valves 31 to 34 are placed at normal positions, and a parallel passage 36 provided in parallel to the second neutral passage 35.

On the downstream side of the operation valve 34 in the second neutral passage 35, a throttle 37 for generating pilot pressure as negative control pressure is provided. In the throttle 37, a pilot relief valve 38 to be opened when the pilot pressure generated on the upstream side of the throttle 37 exceeds predetermined pilot relief pressure to maintain the pilot pressure to the pilot relief pressure or lower is provided in parallel. The predetermined pilot relief pressure is set to be lower than the main relief pressure of the main relief valve 18 so that abnormal pressure is not generated in the throttle 37.

On the upstream side of the throttle 37, a second pilot passage 39 is connected. The pilot pressure generated by the throttle 37 is guided to the second pilot passage 39. The second pilot passage 39 is connected to the lower pressure selection circuit 40.

The operation valves 31 to 34 control a flow rate of the working oil guided from the hydraulic pump 10 to the actuators to control the actions of the actuators. The operation valves 31 to 34 are operated by pilot pressure supplied in accordance with a manual operation of the operation lever by the operator of the hydraulic excavator 1.

The operation valve 31 is normally placed at the normal position by bias force of a pair of centering springs, and switched between a first switching position and a second switching position by pilot pressure supplied from pilot passages 31*a*, 31*b*. The operation valve 32 is normally placed at the normal position by bias force of a pair of return springs, and switched between a first switching position and a second switching position by pilot pressure supplied from pilot passages 32*a*, 32*b*. The operation valve 33 is normally placed at the normal position by bias force of a pair of return springs, and switched between a first switching position and a second switching position by pilot pressure supplied from pilot passages 33*a*, 33*b*. The operation valve 34 is normally placed at the normal position by bias force of a pair of return springs, and switched between a first switching position and a second switching position by pilot pressure supplied from pilot passages 34*a*, 34*b*.

Figure 2:
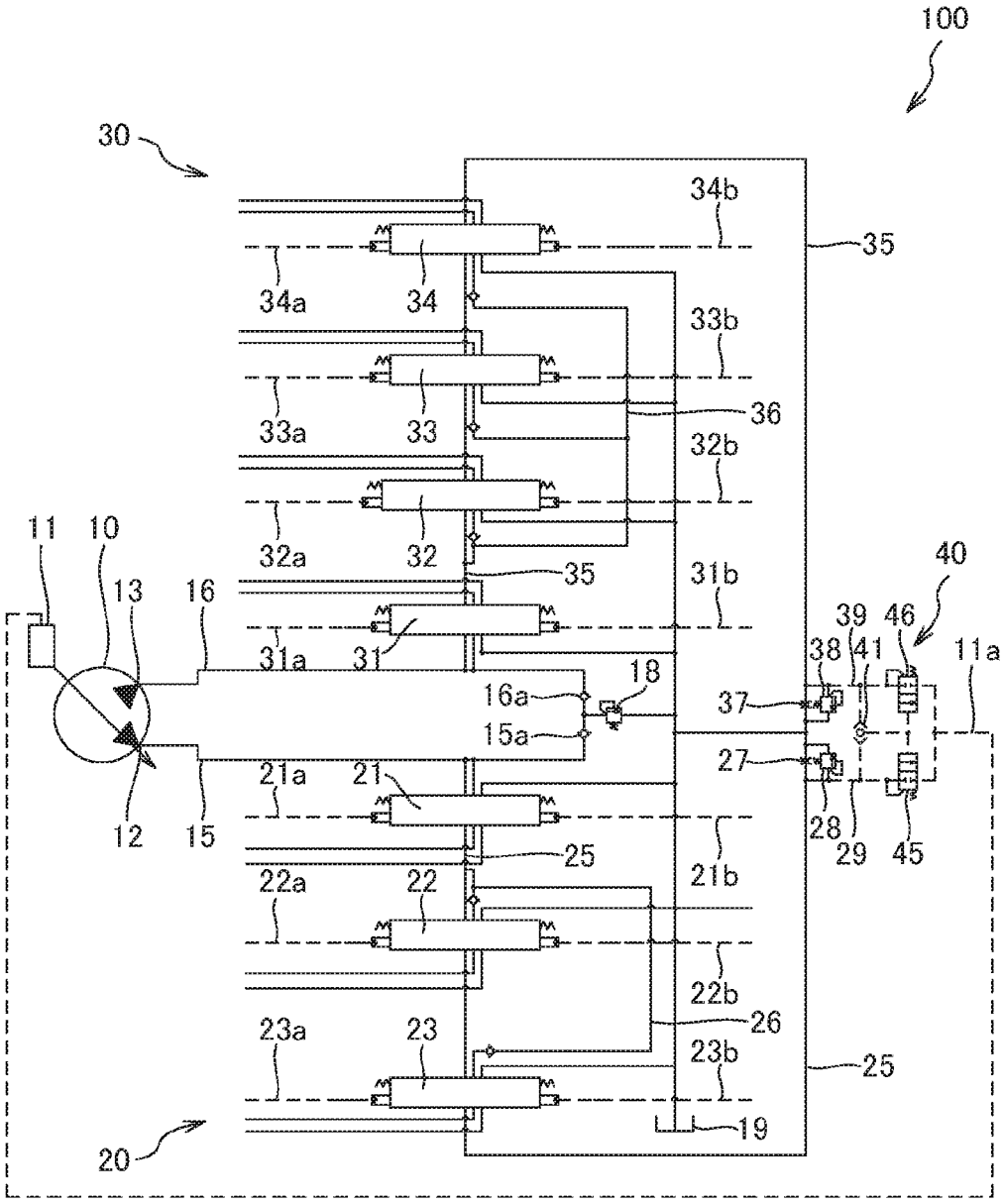
FIG. 2 is a circuit diagram of the working machine control system according to the embodiment of the present invention.

As shown in FIG. 2, the lower pressure selection circuit 40 includes a shuttle valve 41 serving as a higher pressure selection valve adapted to select working oil on the high pressure side among the first neutral passage 25 serving as a first fluid passage and the second neutral passage 35 serving as a second fluid passage, and a first switching valve 45 and a second switching valve 46 serving as a switching valve to be switched by pressure of the working oil selected by the shuttle valve 41, the switching valves being adapted to block the working oil on the high pressure side among the first neutral passage 25 and the second neutral passage 35, and guide working oil on the low pressure side to the regulator 11 through a pilot passage 11*a* as the pilot pressure.

The shuttle valve 41 selects any one working oil on the high pressure side among the first pilot passage 29 connected to the first neutral passage 25 and the second pilot passage 39 connected to the second neutral passage 35 and the guides the working oil to a pilot passage 41*a*.

Figure 3:
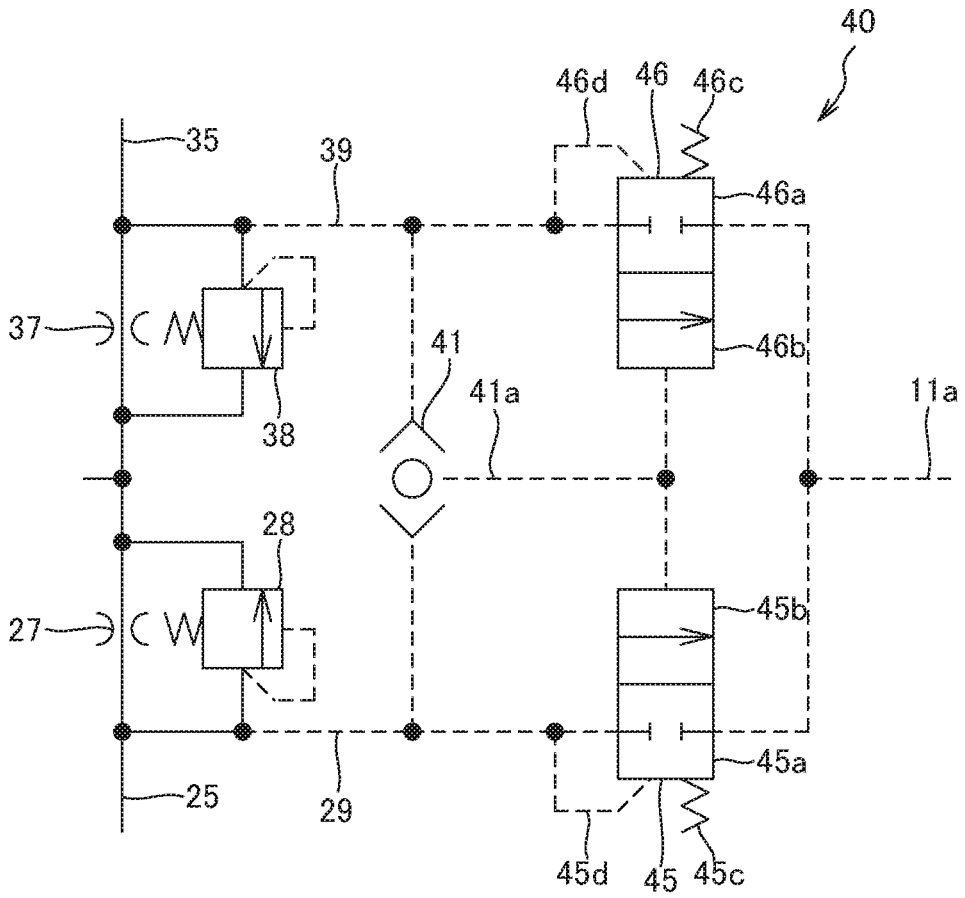
FIG. 3 is an enlarged diagram of a lower pressure selection circuit in FIG. 2.

As shown in FIG. 3, the first switching valve 45 includes a blocking position 45*a* to block the working oil from the first pilot passage 29, and a communicating position 45*b* to communicate with the working oil from the first pilot passage 29. The first switching valve 45 includes a spool (not shown) in which pilot pressure of the pilot passage 41*a* is applied to one side, and bias force of a return spring 45*c* and pilot pressure of a pilot passage 45*d* are applied to the other side. Working oil pressure of the first pilot passage 29 is guided to the pilot passage 45*d*.

Similarly, the second switching valve 46 includes a blocking position 46*a* to block the working oil from the second pilot passage 39, and a communicating position 46*b* to communicate with the working oil from the second pilot passage 39. The second switching valve 46 includes a spool (not shown) in which the pilot pressure of the pilot passage 41*a* is applied to one side, and bias force of a return spring 46*c* and pilot pressure of a pilot passage 46*d* are applied to the other side. Working oil pressure of the second pilot passage 39 is guided to the pilot passage 46*d*.

One of the first switching valve 45 and the second switching valve 46 is switched to the communicating position 45*b*, 46*b* by the pressure of the working oil selected by the shuttle valve 41, and the passing working oil is guided to the regulator 11 as the pilot pressure.

Hereinafter, operations of the control system 100 will be described.

Firstly, a case where all the actuators of the hydraulic excavator 1 are not activated and the operation valves 21 to 23 of the first circuit system 20 and the operation valves 31 to 34 of the second circuit system 30 are all placed at the normal positions will be described.

The working oil discharged from the hydraulic pump 10 is proportionally divided into the first neutral passage 25 and the second neutral passage 35 and guided to the lower pressure selection circuit 40. The pilot pressure of the first pilot passage 29 connected to the first neutral passage 25 and the pilot pressure of the second pilot passage 39 connected to the second neutral passage 35 are guided to the lower pressure selection circuit 40. The pilot pressure of the first pilot passage 29 and the pilot pressure of the second pilot passage 39 have different magnitude depending on pipe resistance or the like. A case where the pilot pressure of the first pilot passage 29 is higher than the pilot pressure of the second pilot passage 39 will be described herein.

The shuttle valve 41 guides the pilot pressure of the first pilot passage 29 on the high pressure side to the pilot passage 41*a*. Since the pilot pressure of the pilot passage 45*d* and the pilot pressure of the pilot passage 41*a* are substantially the same, the first switching valve 45 is switched to the blocking position 45*a* by the bias force of the return spring 45*c*. Meanwhile, since the pilot pressure of the pilot passage 46*d* is lower than the pilot pressure of the pilot passage 41*a*, a pressure difference thereof overcomes the bias force of the return spring 46*c*, and the second switching valve 46 is switched to the communicating position 46*b*.

In such a way, the pilot pressure of the second pilot passage 39 passing through the second switching valve 46 is guided to the regulator 11 of the hydraulic pump 10 through the pilot passage 11*a*. At this time, the operation valves 21 to 23 of the first circuit system 20 and the operation valves 31 to 34 of the second circuit system 30 are all placed at the normal positions. Therefore, the working oil is not guided to the actuators, and the pilot pressure guided to the regulator 11 is relatively high. Thus, in the hydraulic pump 10, the inclination angle of the swash plate is adjusted in such a manner that the discharge flow rate is decreased. Therefore, in a case where the operation valves 21 to 23 and the operation valves 31 to 34 are not operated, the hydraulic pump 10 is adjusted to have the minimum discharge flow rate.

Next, a case where an operation is made to pivot the boom 6 of the hydraulic excavator 1 will be described as an example.

At the time of pivoting the boom 6, by the operator operating the operation lever, the pilot pressure is supplied from the pilot passage 22*a* or the pilot passage 22*b*, the operation valve 22 is switched to the first switching position or the second switching position. Thereby, part of the working oil guided from the first discharge port 12 of the hydraulic pump 10 to the first circuit system 20 is guided from the operation valve 22 to the boom cylinder 6*a*. Therefore, the working oil pressure of the first neutral passage 25 on the downstream of the operation valve 22 is lowered more than a case where the boom 6 is not pivoted.

At this time, the pilot pressure of the first pilot passage 29 guided to the lower pressure selection circuit 40 is lower than the pilot pressure of the second pilot passage 39. Therefore, the shuttle valve 41 guides the pilot pressure of the second pilot passage 39 on the high pressure side to the pilot passage 41*a*.

Since the pilot pressure of the pilot passage 45*d* is lower than the pilot pressure of the pilot passage 41*a*, a pressure difference thereof overcomes the bias force of the return spring 45*c*, and the first switching valve 45 is switched to the communicating position 45*b*. Meanwhile, since the pilot pressure of the pilot passage 46*d* and the pilot pressure of the pilot passage 41*a* are substantially the same, the second switching valve 46 is switched to the blocking position 46*a* by the bias force of the return spring 46*c*.

In such a way, the pilot pressure of the first pilot passage 29 passing through the first switching valve 45 is guided to the regulator 11 of the hydraulic pump 10 through the pilot passage 11*a*. At this time, the operation valve 22 of the first circuit system 20 is switched to the first switching position or the second switching position. Therefore, the pilot pressure guided to the regulator 11 is lower than a case where the operation valve 22 is placed at the normal position. Thus, in the hydraulic pump 10, the inclination angle of the swash plate is adjusted in such a manner that the discharge flow rate is increased.

As described above, in a case where the operation valve 22 of the first circuit system 20 is operated and the boom cylinder 6*a* is actuated, the pressure of the working oil on the downstream of the first neutral passage 25 of the first circuit system 20 is lowered. Therefore, the pilot pressure of the first pilot passage 29 on the lowered side is selected by the lower pressure selection circuit 40, and the discharge flow rate of the hydraulic pump 10 is adjusted to be increased by the selected pilot pressure. Thus, in a case where the operation valve 22 is operated, the discharge flow rate is adjusted to be a discharge flow rate required for actuating the boom cylinder 6*a*.

Meanwhile, for example, in a case where an operation is made to pivot the arm 7 of the hydraulic excavator 1, part of the working oil guided from the second discharge port 13 of the hydraulic pump 10 to the second circuit system 30 is guided from the operation valve 34 to the arm cylinder 7*a*. By similar operations, the pilot pressure of the second pilot passage 39 is selected by the lower pressure selection circuit 40, and the discharge flow rate of the hydraulic pump 10 is adjusted to be increased by the selected pilot pressure. Therefore, in a case where the operation valve 34 is operated, the discharge flow rate is adjusted to be a discharge flow rate required for actuating the arm cylinder 7*a*.

Thus, in the control system 100, by using the lower pressure selection circuit 40, without using a pressure sensor, a controller, and the like, the discharge flow rate of the hydraulic pump 10 can be adjusted with a simple configuration.

According to the above embodiment, the following effects are exerted.

In a case where the operation valves 21 to 23 of the first circuit system 20 are operated and the actuators are activated, the pressure of the working oil on the downstream of the first neutral passage 25 of the first circuit system 20 is lowered. Therefore, the pilot pressure of the first pilot passage 29 is selected by the lower pressure selection circuit 40, and the discharge flow rate of the hydraulic pump 10 is adjusted to be increased.

Similarly, in a case where the operation valves 31 to 34 of the second circuit system 30 are operated and the actuators are activated, the pressure of the working oil on the downstream of the second neutral passage 35 of the second circuit system 30 is lowered. Therefore, the pilot pressure of the second pilot passage 39 is selected by the lower pressure selection circuit 40, and the discharge flow rate of the hydraulic pump 10 is adjusted to be increased.

Thus, in a case where the operation valves 21 to 23, 31 to 34 are not operated, the hydraulic pump 10 is adjusted to have the minimum discharge flow rate. In a case where any of the operation valves 21 to 23, 31 to 34 are operated, the hydraulic pump 10 is adjusted to have a discharge flow rate required for activating the actuators. Therefore, without using a pressure sensor, a controller, and the like, the discharge flow rate of the hydraulic pump 10 can be adjusted with a simple configuration.

Figure 4:
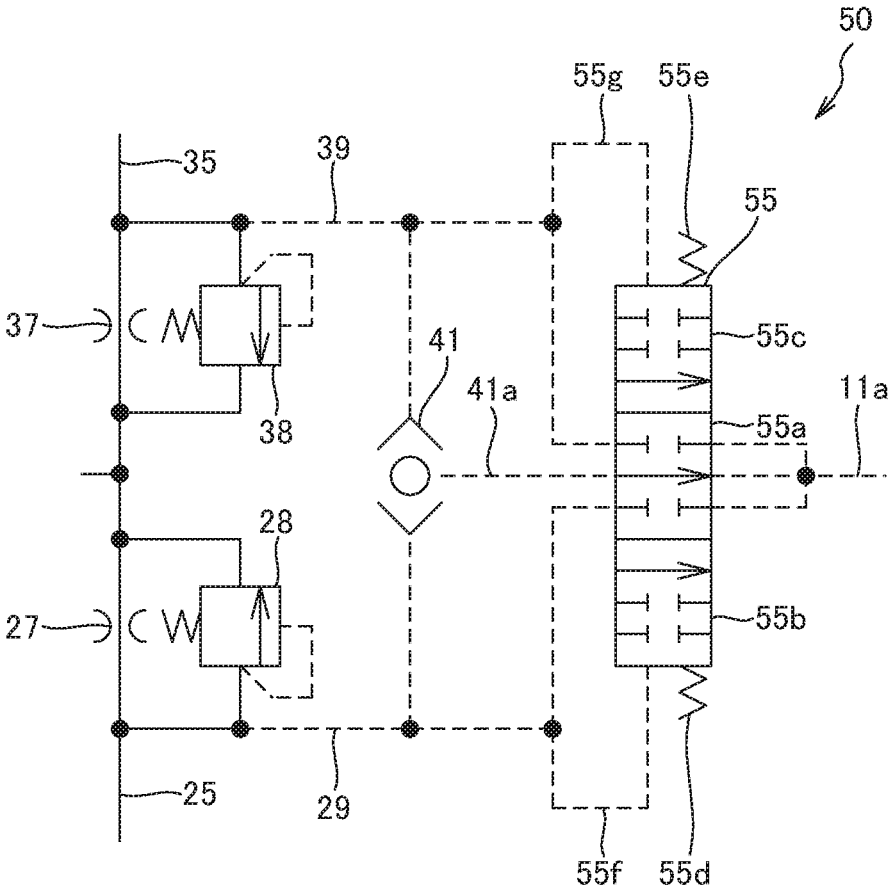
FIG. 4 is a diagram for illustrating a modified example of the lower pressure selection circuit.

Next, with reference to FIG. 4, a lower pressure selection circuit 50 according to a modified example will be described. The lower pressure selection circuit 50 is different from the lower pressure selection circuit 40 in a point where a single switching valve 55 is provided.

The lower pressure selection circuit 50 includes a shuttle valve 41 serving as a higher pressure selection valve adapted to select the working oil on the high pressure side among the first neutral passage 25 and the second neutral passage 35, and a switching valve 55 to be switched by the pressure of the working oil selected by the shuttle valve 41, the switching valve being adapted to block the working oil on the high pressure side among the first neutral passage 25 and the second neutral passage 35, and guide the working oil on the low pressure side to the regulator 11 through the pilot passage 11*a* as the pilot pressure.

The switching valve 55 includes a first switching position 55*a* to block the working oil from the first pilot passage 29 and the second pilot passage 39 and communicate with only the working oil from the pilot passage 41*a*, a second switching position 55*b* to communicate with only the working oil from the second pilot passage 39, and a third switching position 55*c* to communicate with only the working oil from the first pilot passage 29. The switching valve 55 includes a spool (not shown) in which bias force of a centering spring 55*d* and pilot pressure of a pilot passage 55*f* are applied to one side, and bias force of a centering spring 55*e* and pilot pressure of a pilot passage 55*g* are applied to the other side. The working oil pressure of the first pilot passage 29 is guided to the pilot passage 55*f*, and the working oil pressure of the second pilot passage 39 is guided to the pilot passage 55*g*.

In a case where there is almost no difference in the pilot pressure between the first pilot passage 29 and the second pilot passage 39, the switching valve 55 is switched to the first switching position 55*a* by the bias force of the centering springs 55*d*, 55*e*.

In a case where the pilot pressure of the first pilot passage 29 is higher than the pilot pressure of the second pilot passage 39, the switching valve 55 is switched to the second switching position 55*b* by the pilot pressure of the pilot passage 55*f*. Thereby, the pilot pressure of the second pilot passage 39 which is lower than the pressure of the first pilot passage 29 is guided to the regulator 11 of the hydraulic pump 10 through the pilot passage 11*a*.

Similarly, in a case where the pilot pressure of the second pilot passage 39 is higher than the pilot pressure of the first pilot passage 29, the switching valve 55 is switched to the third switching position 55*c* by the pilot pressure of the pilot passage 55*g*. Thereby, the pilot pressure of the first pilot passage 29 which is lower than the pressure of the second pilot passage 39 is guided to the regulator 11 of the hydraulic pump 10 through the pilot passage 11*a*.

In such a way, even in a case where the lower pressure selection circuit 50, similarly to the lower pressure selection circuit 40, in a case where the operation valves 21 to 23, 31 to 34 are not operated, the hydraulic pump 10 is adjusted to have the minimum discharge flow rate. In a case where any of the operation valves 21 to 23, 31 to 34 are operated, the hydraulic pump is adjusted to have a discharge flow rate required for activating the actuators. Therefore, without using a pressure sensor, a controller, and the like, the discharge flow rate of the hydraulic pump 10 can be adjusted with a simple configuration.

Since the single switching valve 55 is used in the lower pressure selection circuit 50, cost can be reduced in comparison to the lower pressure selection circuit 40 in which the first switching valve 45 and the second switching valve 55 are used as the switching valve.

Although an embodiment of the present invention has been described, the embodiment is merely one of application examples of the present invention and by no means limits the technical scope of the present invention to a specific configuration of the above-mentioned embodiment.

This application claims priority to Japanese Patent Application No. 2014-016473 filed in the Japanese Patent Office on Jan. 31, 2014, the entire contents of which are incorporated by reference herein.

The invention claimed is:

1. A lower pressure selection circuit, comprising:

a higher pressure selection valve configured to select a high pressure side passage from among a first fluid passage and a second fluid passage, a working fluid flowing through the high pressure side passage having a pressure higher than a pressure of the working fluid flowing through the other one of the first fluid passage and the second fluid passage; and a switching valve connected to a pilot passage, and being configured to, by the pressure of the working fluid flowing through the high pressure side passage selected by the higher pressure selection valve, block the high pressure side passage from communicating with the pilot passage, and allow the other one of the first fluid passage and the second fluid passage to communicate with the pilot passage.

2. The lower pressure selection circuit according to claim 1, wherein the switching valve receives the working fluid having a first pressure, passing through the first fluid passage, and the working fluid having a second pressure, passing through the second fluid passage, blocks the high pressure side passage from communicating with the pilot passage, using the pressure of the working fluid flowing through the high pressure side passage, and one of the first pressure and the second pressure, and allows the other one of the first fluid passage and the second fluid passage to communicate with the pilot passage, using the pressure of the working fluid flowing through the high pressure side passage, and the other one of the first pressure and the second pressure.

3. The lower pressure selection circuit according to claim 1, wherein the switching valve includes a first switch valve connected to the first fluid passage and a second switch valve connected the second fluid passage, when the first fluid passage is the high pressure side passage, the first switching valve blocks the first fluid passage from communicating with the pilot passage, while the second switching valve allows the second fluid passage to communicate with the pilot passage, and when the second fluid passage is the high pressure side passage, the first switching valve allows the first fluid passage to communicate with the pilot passage, while the second switching valve blocks the second fluid passage from communicating with the pilot passage.

4. The lower pressure selection circuit according to claim 1, wherein the switching valve always blocks the high pressure side passage from communicating with the pilot passage.

5. A working machine control system comprising the lower pressure selection circuit according to claim 1, and being configured to control a working machine having a first actuator and a second actuator, comprising:

a split flow type fluid pressure pump configured to discharge the working fluid from a first discharge port and a second discharge port;

a first circuit system to which the working fluid discharged from the first discharge port is supplied, the first circuit system having a first operation valve configured to control the first actuator, and a first neutral passage providing communication between the first discharge port and a tank in a state where the first operation valve is placed at a normal position;

a second circuit system to which the working fluid discharged from the second discharge port is supplied, the second circuit system having a second operation valve configured to control the second actuator, and a second neutral passage providing communication between the second discharge port and the tank in a state where the second operation valve is placed at a normal position; and the lower pressure selection circuit configured to select and communicate with the working fluid of a lower pressure among the working fluid on a downstream of the first operation valve of the first neutral passage, and the working fluid on a downstream of the second operation valve of the second neutral passage, the first neutral passage being connected to the first fluid passage, the second neutral passage being connected to the second fluid passage, wherein the fluid pressure pump includes a swash plate whose inclination angle is adjusted by a single regulator to be controlled with the pressure of the working fluid selected by the lower pressure selection circuit as a pilot pressure, and the discharge flow rate is adjusted by the regulator, the fluid pressure pump being adjusted in such a manner that the lower the pressure of the working fluid selected by the lower pressure selection circuit is, the more a discharge flow rate is increased, and wherein the switching valve of the lower pressure selection circuit is configured to guide the working fluid on the low pressure side to the regulator as the pilot pressure.

6. The working machine control system according to claim 5, wherein the switching valve includes:

a first switching valve configured to block the working fluid from the first neutral passage; and a second switching valve configured to block the working fluid from the second neutral passage, wherein one of the first switching valve and the second switching valve is switched into a communication state by the pressure of the working fluid selected by the higher pressure selection valve, and a passing working fluid is guided to the regulator as the pilot pressure.

* * * * *